US005996569A

United States Patent [19]

Wilson

[11] Patent Number: 5,996,569

[45] Date of Patent: Dec. 7, 1999

[54] TRANSPARENT REAR BOW SIGHT

[76] Inventor: Keith W. Wilson, 304 Ash Rd., Tuckerton, N.J. 08087

[21] Appl. No.: 09/053,760

[22] Filed: Apr. 2, 1998

Related U.S. Application Data

[60] Provisional application No. 60/042,401, Apr. 25, 1997.

[51] Int. Cl.[6] ..... F41G 1/467

[52] U.S. Cl. ..... 124/87; 33/265

[58] Field of Search ..... 124/87; 33/265

[56] References Cited

U.S. PATENT DOCUMENTS

| | | | |
|---|---|---|---|
| 4,011,853 | 3/1977 | Fletcher | 124/87 |
| 4,116,194 | 9/1978 | Topel | 124/87 |
| 4,552,121 | 11/1985 | Treaster | 124/87 |
| 4,928,394 | 5/1990 | Sherman | 33/265 |
| 4,961,264 | 10/1990 | Topel | 33/265 |
| 5,137,007 | 8/1992 | Shoemake et al. | 124/87 |
| 5,148,603 | 9/1992 | Beutler | 33/265 |
| 5,325,598 | 7/1994 | Hall et al. | 33/265 |
| 5,347,976 | 9/1994 | Saunders | 124/87 |
| 5,379,747 | 1/1995 | Morris et al. | 124/87 |
| 5,388,336 | 2/1995 | Pomaville | 33/265 |
| 5,442,861 | 8/1995 | Lorocco | 33/241 |
| 5,450,673 | 9/1995 | Denton | 33/265 |
| 5,495,675 | 3/1996 | Huang | 33/241 |
| 5,542,186 | 8/1996 | Saunders | 33/265 |
| 5,669,146 | 9/1997 | Beutler | 33/265 |
| 5,697,357 | 12/1997 | Chipman | 124/87 |

FOREIGN PATENT DOCUMENTS 1239593 7/1960 France .

OTHER PUBLICATIONS

"Archery," vol. 38, #7, Jul. 1966, pp. 18, 35.

"Bow & Arrow," Aug. 1986, p. 19.

Advertisement: Optectron, Flourescent Plastic Optical Fibers, Sep. 1991.

*Primary Examiner*—John A. Ricci
*Attorney, Agent, or Firm*—Richard C. Litman

[57] ABSTRACT

An improved rear bow sight used in archery. The present invention is a bowstring mounted rear peep sight formed of clear, preferably acrylic, material. The transparent characteristic of the present invention allows the archer to align the rear bow sight with the forward sight pin, while remaining focused on the position on the target at which the archer is aiming. A second embodiment of the present invention includes an ambient light collecting fiber which acts as a rear transparent sight pin within a sight window. The light collecting fiber is wrapped about the sight in order to collect ambient light, while the second end of the fiber acts as the sight pin and is centrally positioned within the sight window. The sight pin provides an illumination point for alignment with a forward sight in order to set proper aim at a target. A third embodiment of the present invention uses a surface to help contrast the illumination point of the sight pin against the surrounding environment in order to better view the sight pin. Another embodiment uses two fibers as pin sights along with an enlarged contrasting member to enhance visibility of the pin sight.

7 Claims, 5 Drawing Sheets

TRANSPARENT REAR BOW SIGHT

CROSS-REFERENCE TO RELATED APPLICATION

This application claims the benefit of U.S. Provisional patent application Ser. No. 60/042,401, filed Apr. 25, 1997.

BACKGROUND OF THE INVENTION

1. Field of the Invention

The present invention relates to a rear bow sight for archery. More specifically, the invention is a bowstring mounted rear peep sight formed of clear, preferably acrylic, material.

2. Description of Related Art

Many devices have been developed to help archers and hunters to improve their accuracy. Conventional bowstring mounted peep sights have a small hole therethrough which when lined up with a forward sight pin mounted on the bow may substantially increase the accuracy of the archer. One problem with the conventional peep sight is that the peep sight only allows the archer to see a small spot on the target, and therefore does not allow the archer to easily see where on the target he is aiming. A second problem with the conventional peep sight is that at dusk, or other low light situations, it is extremely difficult to align the peep sight with the forward sight. In the sport of deer hunting, a lot of shots occur at dusk, therefore a conventional peep sight may not be an effective method for improving the accuracy of deer or other game hunters.

Consequently a rear bow sight is needed that allows the archer to align the rear bow sight with the forward pin sight, while remaining focused on the position on the target at which the archer is aiming. The rear bow sight should include an ambient light collecting fiber which acts as a rear transparent sight pin within a sight window. The rear bow sight should have a sight pin that provides an illumination point for alignment with a forward sight in order to set proper aim at a target. The rear bow sight should also include a surface to help contrast the illumination point of the sight pin against the surrounding environment in order to better view the sight pin.

The following are examples of inventions that attempt to achieve some or all of the above goals, yet fail to achieve them as fully and effectively as the present invention.

U.S. Pat. No. 5,137,007, issued on Aug. 11, 1992, to Robert C. Shoemake et al. describes a peep sight with interchangeable inserts, each with a different size hole through it so that different field conditions can be covered without having to change and recalibrate the sight. The invention further provides a nocking arrangement that serves to locate the arrow longitudinally on the bowstring while at the same time serving to rotationally orient the peep sight.

U.S. Pat. No. 5,325,598, issued on Jul. 5, 1994, to David D. Hall et al. describes a variable aperture peep sight for bows which includes a peep housing defining a fixed diameter peep hole and a disc receiving slot. The invention also includes one or more aperture reducing discs, formed to fit within the receiving slot, having a peep hole located axially therein to cause the aperture of the peep hole to vary when the discs are inserted into the receiving slot.

U.S. Pat. No. 5,347,976, issued on Sep. 20, 1994, to Charles A. Saunders describes a bowstring mounted peep sight having a relatively large open sight window for ensuring good vision over a substantial field to be surveyed, and a small peep hole for enhanced target accuracy that is fixed in the center of the sight window by several axial ribs.

U.S. Pat. No. 5,379,747, issued on Jan. 10, 1995, to Eddy D. Morris et al. describes a rear peep sight with a large sight window and a device for preventing the sight from twisting during use.

U.S. Pat. No. 5,388,336, issued on Feb. 14, 1995, to Louis F. Pomaville describes a sight system including a forward pendulum sight and a rear peep sight.

U.S. Pat. No. 5,442,861, issued on Aug. 22, 1995, to Paul M. Lorocco describes a sight unit including a pin and holder adaptable for mounting onto the sight assembly of an archery bow and including an elongated length of a light gathering fluorescent fiber defining a lens at its distal end to which gathered ambient light becomes focused to serve as an aiming indicia.

U.S. Pat. No. 5,450,673, issued on Sep. 19, 1995, to Don Denton describes a rotating disk peep sight system including a round disk with a hole punched in the center and sized to receive a bowstring. The disk has one or more holes punched near the rim used as sighting openings.

U.S. Pat. No. 5,495,675, issued on Mar. 5, 1996, to Chaochi Huang describes a laser sight that may be attached to the bow and a view hole attached to the bowstring.

U.S. Pat. No. 5,542,186, issued on Aug. 6, 1996, to Charles A. Saunders describes a bowstring mounted peep sight having a skeletal ring and an interiorly mounted transversely extending frame which defines a peep sight. The areas within the skeletal ring but outside of the peep sight are used for viewing general target areas and the peep sight is used for viewing the specific target area.

French Patent Application Number 1,239,593, published on Jul. 18, 1960, shows a peep sight attached to a sleeve which has the bowstring running therethrough.

The advertisement, 'NO SERVE' PEEP, published in Bow & Arrow, in August of 1986, on page 19, shows a peep sight capable of self-locking onto to a bowstring without the need for tying or serving the peep sight into the bowstring.

The brochure, FLUORESCENT PLASTIC OPTICAL FIBERS, published in Optectron, in September of 1991, on pages 1 and 2 shows an example of the ambient light gathering fiber used is weaponry sights.

None of the above inventions, patents or publications describes a transparent rear bow sight with benefits of increased accuracy. Nor do the above describe the benefits of using an ambient light collecting fiber as a rear transparent sight pin in combination with a forward ambient light collecting fiber as a forward sight pin. Furthermore, none of the above describe the use of a surface to help contrast the illumination point of the sight pin against the surrounding environment in order to better view the sight pin. In short, none of the above inventions, patents or publications, taken either singly or in combination, is seen to describe the instant invention as claimed.

SUMMARY OF THE INVENTION

The present invention relates to an improved rear bow sight used in archery. More specifically, the invention is a bowstring mounted rear peep sight formed of clear, preferably acrylic, material. The transparent characteristic of the present invention allows the archer to align the rear bow sight with the forward sight pin, while remaining focused on the position on the target at which the archer is aiming.

A second embodiment of the present invention includes an ambient light collecting fiber which acts as a rear transparent sight pin within a sight window. The light collecting fiber is wrapped about the sight in order to collect ambient light, while the second end of the fiber acts as the sight pin and is centrally positioned within the sight window. The sight pin provides an illumination point for alignment with a forward sight in order to set proper aim at a target.

A third embodiment of the present invention uses a surface to help contrast the illumination point of the sight pin against the surrounding environment in order to better view the sight pin.

Yet another embodiment uses two fibers as pin sights viewed against an enlarged contrasting member such that the front pin sight is aligned between the two fiber pin sights.

Accordingly, it is a principal object of the invention to provide a transparent rear bow sight that allows the archer to align the rear bow sight with the forward sight pin, while remaining focused on the position on the target at which the archer is aiming.

It is another object of the invention to provide a rear bow sight that includes an ambient light collecting fiber which acts as a rear transparent sight pin within a sight window.

It is a further object of the invention to provide a rear bow sight having a sight pin that provides an illumination point for alignment with a forward sight in order to set proper aim at a target.

Still another object of the invention is to provide a rear bow sight that uses a surface to help contrast the illumination point of the sight pin against the surrounding environment in order to better view the sight pin.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
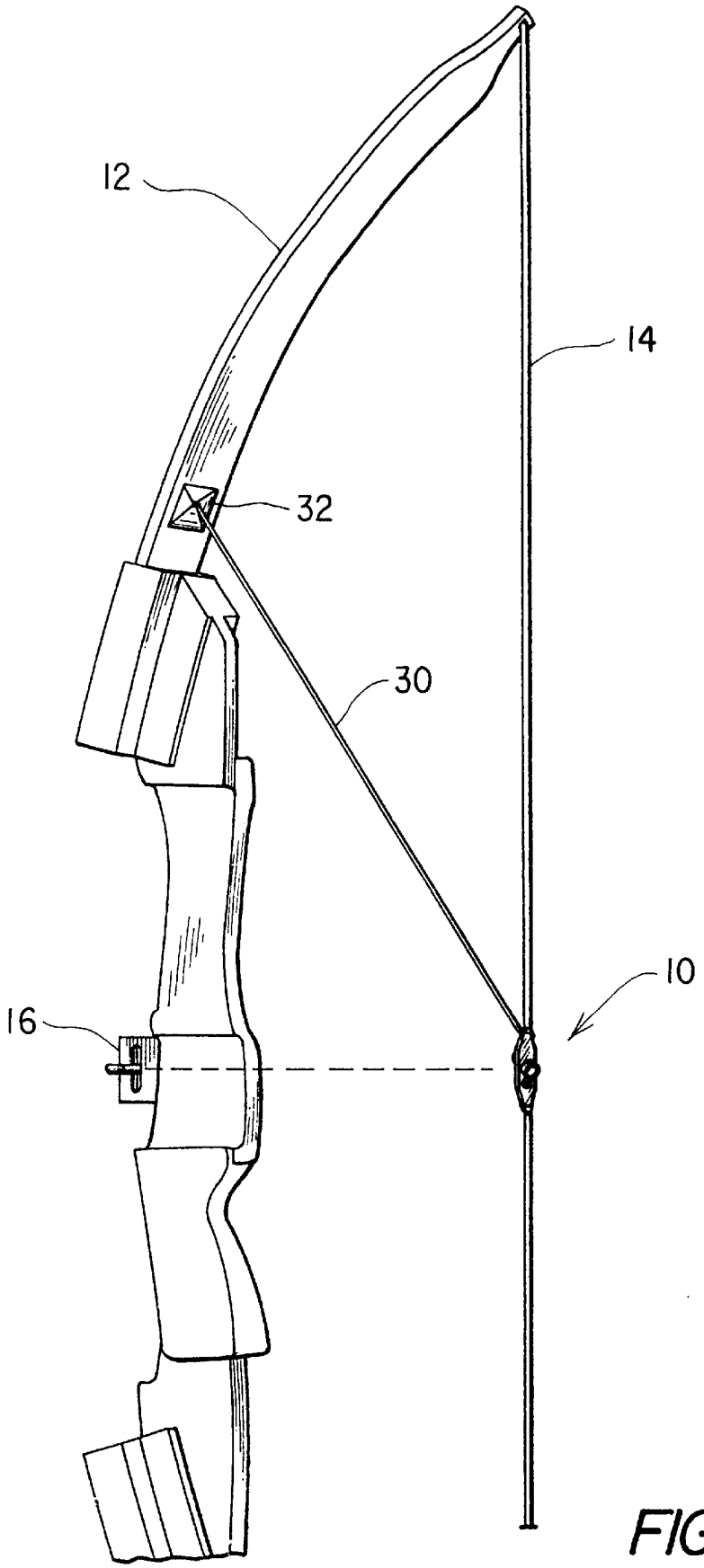
FIG. 1 is an environmental perspective view of a transparent rear bow sight according to the present invention mounted on the bowstring of a compound bow.

Referring to FIG. 1, the present invention relates to an improved rear bow sight used in archery. More specifically, the invention is a rear peep sight 10 that is mounted on a bowstring 14 of a bow 12 and is used in combination with a forward sight pin 16. The rear bow sight 10 is made of a transparent material, such as acrylic or other similarly transparent material. The transparent characteristic of the present invention allows the archer to align the rear bow sight 10 with the forward sight pin 16, while remaining focused on the position of the target at which the archer is aiming.

Figure 2A:
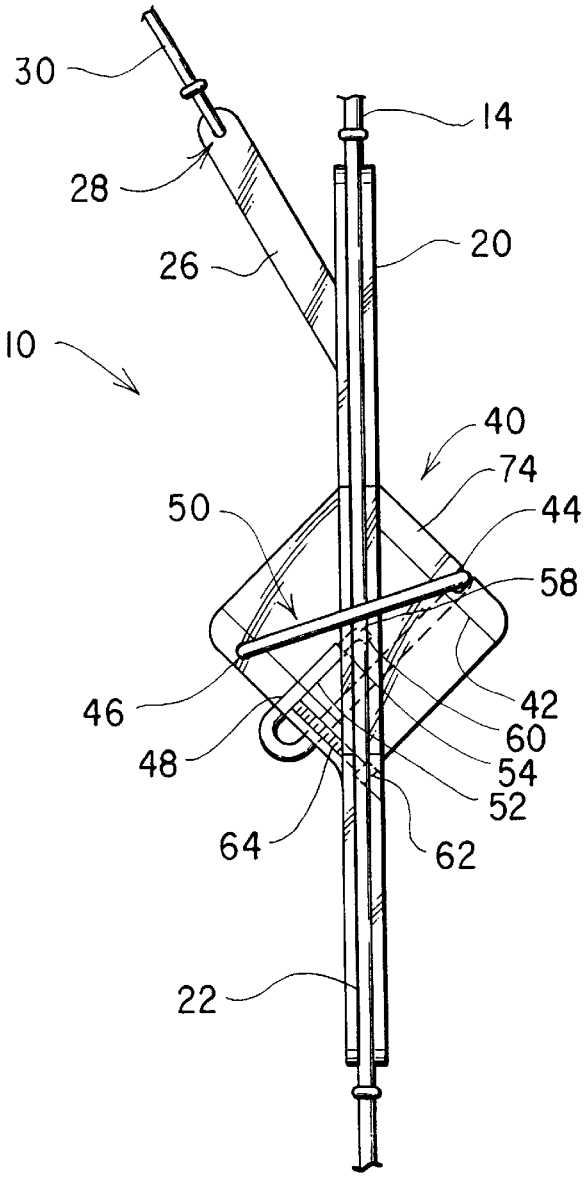
FIG. 2A is a side view of a transparent rear bow sight according to the present invention.
Figure 2B:
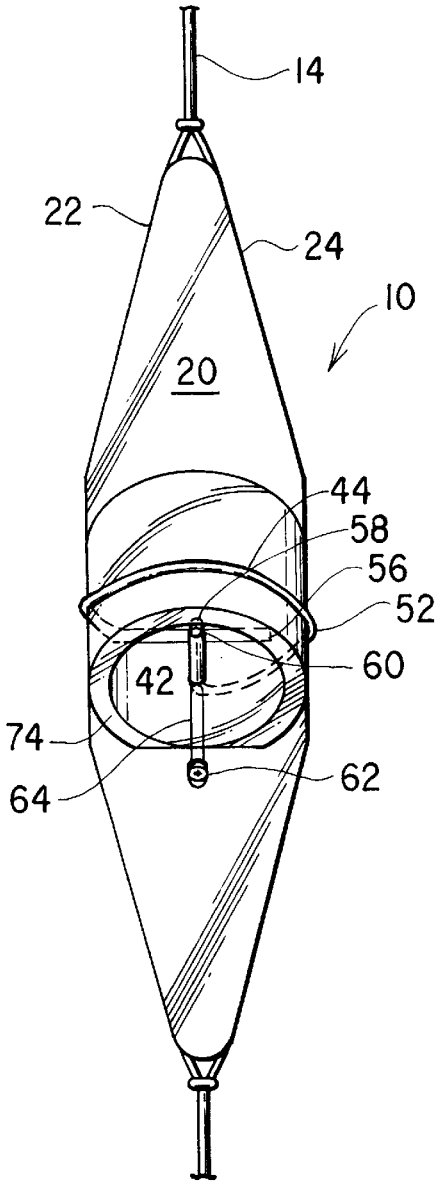
FIG. 2B is a front view of a transparent rear bow sight according to the present invention.
Figure 2C:
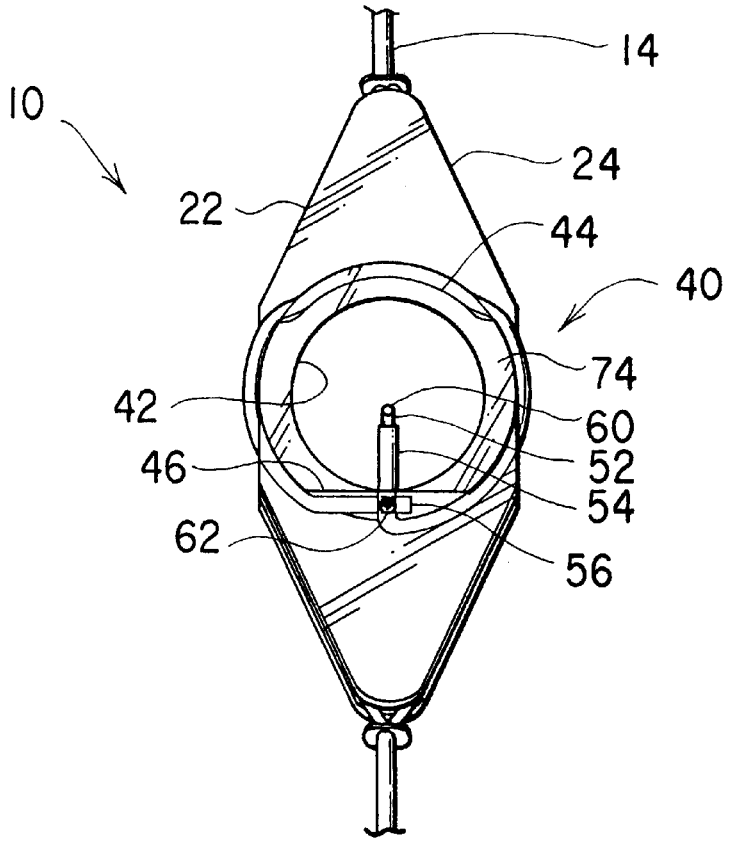
FIG. 2C is a front perspective view of a transparent rear bow sight according to the present invention showing the sight window.

FIGS. 2A, 2B, and 2C show the present invention in detail. The rear bow sight 10 includes a mounting member 20 and a sight portion 40. The mounting member 20 has a pair of grooves, 22 and 24, running along either side thereof. The bowstring 14 extends tightly around either side of the mounting member 20 through grooves, 22 and 24, thereby mounting the bow sight 10 to the bowstring 14. Any conventional mounting method may be used to mount the rear bow sight 10 of the present invention.

The present invention also includes an alignment arm 26 to reduce and help prevent the twisting or axial rotation of the bow sight 10 about the bowstring 14. The alignment arm 26 includes a hole 28 that provides for the attachment of an elastic cord 30 which is attached to the bow 12 by a mount 32. As the bowstring 14 is drawn rearward, the elastic cord 30 will urge the arm 26 in alignment with the bow 12, thus precluding the axial twist of the sight 10 about the bowstring 14 and keeping the sight window disposed generally perpendicular to the line of sight of the archer. In the preferred embodiment the alignment arm extends along a plane which is thirty-five degrees from the plane of the mounting member 20.

The sight portion 40 of the preferred embodiment includes a transparent hollow member 74, preferably centrally disposed at a 45° angle on the mounting member. An aperture 42, which is used by the archer as a sight window, passes completely through the hollow member 74, and consequently the mounting member 20. The 45° angle allows the sight window to come into alignment with the archer's eye and a forward sight 16 when the bowstring 14 is pulled back. In this manner, the bow is aimed at a target. The size of the aperture 42 in the preferred embodiment is 7/16 of an inch, however the aperture 42 may be manufactured at smaller or larger sizes so that the archer may choose the best size. The preferred cross-sectional shape of the hollow member 74 is round, however the aperture 42 may be manufactured with any cross-sectional shape, such as oval, triangular, square, etc.

A second embodiment of the present invention includes an ambient light collecting fiber 54, or fiber optic, which acts as a rear transparent sight pin 60 within the sight window. The light collecting fiber 54 is wrapped about the sight 10 in order to collect ambient light. The sight pin, which is actually a second end 60 of the fiber optic 54, provides an illumination point for alignment with a forward sight 16 in order to set proper aim at a target.

In order to install the light collecting fiber 54, a pre-drilled hole 48 is provided through the lower wall of the hollow member 74 of the sight portion 40. A threaded hole 64 is also provided perpendicularly to the pre-drilled hole 48. A second end 60 of the fiber 54 is slid through the pre-drilled hole 48 and then locked into the desired position with a set or locking screw 62 which is threaded into the threaded hole 64. The fiber 54 should be installed within the sight window 42 with the second end or sight pin 60 in the center of the sight window 42. The fiber 54 has a 90° bend 58 oriented such that the sight pin 60 faces along the axis of the sight window 42 away from the bow 12. The remainder of the fiber 54, which is used for the collection of light, is wrapped around the sight portion 40, over the bowstring 14, through notch 44, down the opposite side of the sight portion 40 and again over the bowstring 14, and finally into the pre-drilled hole 46. Epoxy resin or some other type of glue is used to hold the first end 56 of the fiber 54 in place within hole 46.

The fiber 54 may be housed within a clear sleeve 52. The second end 60 of the fiber 54 extends beyond the sleeve 52 for use as a small, clear sight pin 60.

Figure 3:
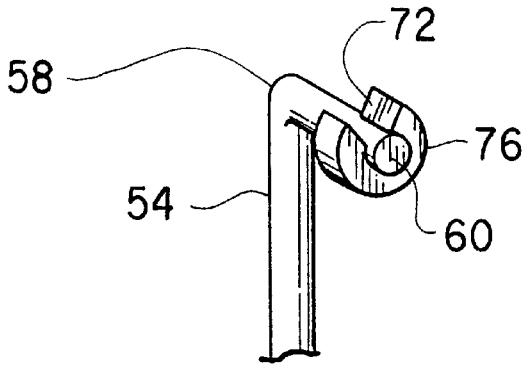
FIG. 3 is a perspective view of a sight pin according to the present invention.

A contrasting member 76 having a surface 70, shown in FIG. 3, to help contrast the illumination point of the sight pin 60 against the surrounding environment in order to better view the sight pin 60. The preferred embodiment of the contrasting member 76 is a small grommet directly adhered onto the second end 60 of the fiber. The contrasting member 76 encloses the outside edge of the sight pin at its illumination point 60, except for the top portion 72. The contrasting member 76 encloses all but the top thirty degrees of the outside edge of the illumination point 60; that is to say the contrasting member 76 extends circumferentially on the lower 330° of the sight pin 60. The open top portion 72 allows the archer to easily see through the rear sight pin 60 and align the forward sight pin 16 with the inside surface of the contrasting member 76.

The contrasting member 76 is preferably made of 1/16 of an inch of rubber or plastic, however other materials of varying sizes may alternatively be used. The main characteristic that the contrasting member 76 should have is that it stays adhered to the sight pin 60 and maintains its shape. The surface 70 is preferably solidly colored either black, for very bright conditions, or white, for cloudy or dark conditions, in order to best contrast with the illumination point.

Figure 4:
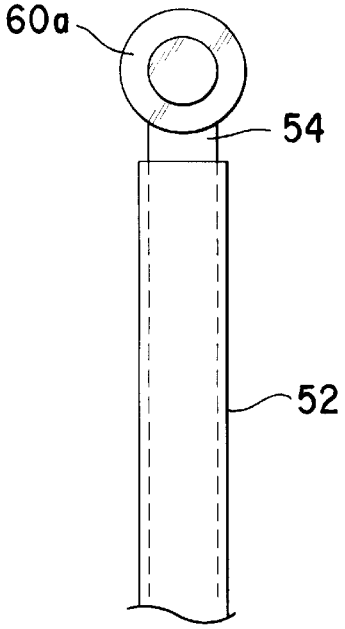
FIG. 4 is a front view of a hollow sight pin according to the present invention.

The illumination point, or sight pin, may take on many shapes, including a hollow circle 60*a* as shown in FIG. 4. In this particular embodiment, the archer would align the hollow center with the forward sight when aiming the bow.

Figure 5A:
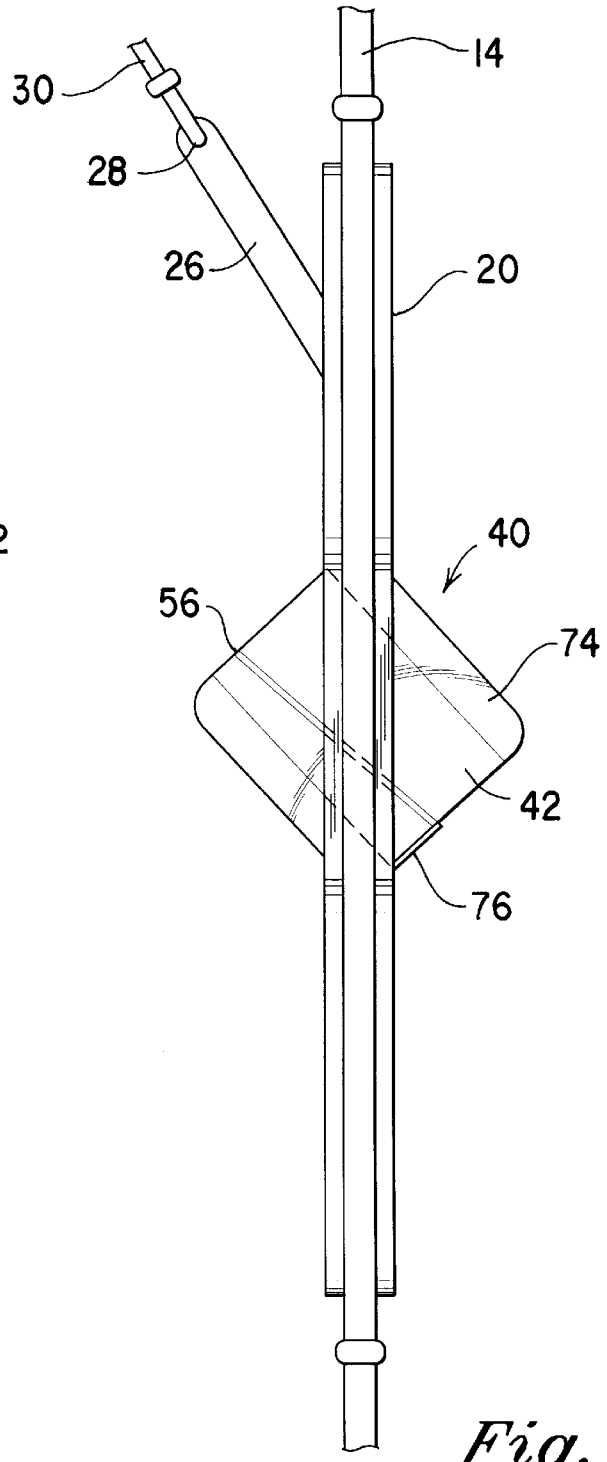
FIG. 5A is a side view of an alternative transparent rear bow sight according to the present invention.
Figure 5B:
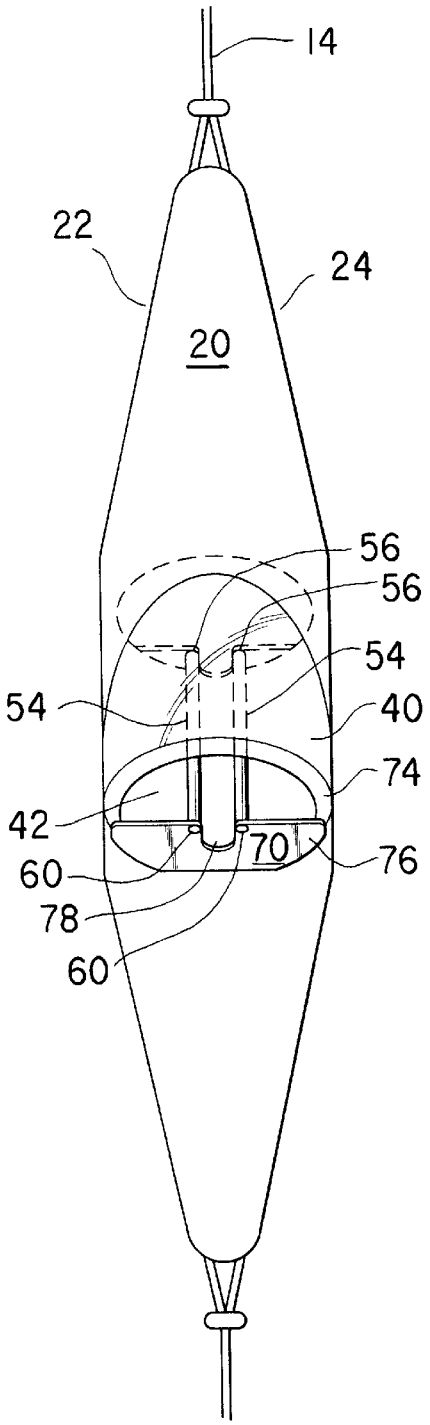
FIG. 5B is a front view of an alternative transparent rear bow sight according to the present invention.
Figure 5C:
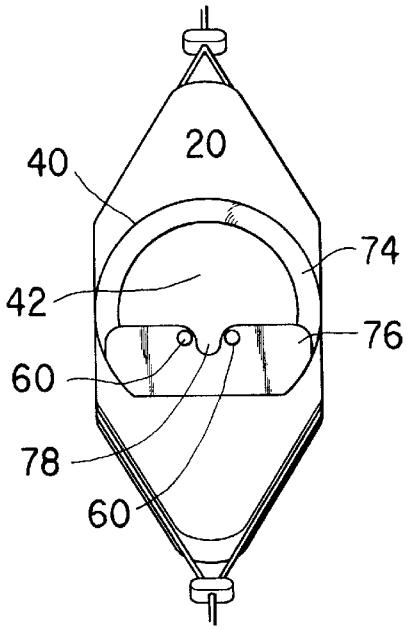
FIG. 5C is a front perspective view of an alternative transparent rear bow sight according to the present invention showing the sight window.

Yet another embodiment is shown in FIGS. 5A, 5B, and 5C. This embodiment is nearly identical to those above except that two fiber optics 54 are used as sight pins, and a larger contrasting member 76 is used. Each fiber 54 has a first end 56, a middle portion, and a second end 60. The first end 56 is oriented toward the bow 12 while the second faces the archer. The middle portion extends across the wall of the hollow member 74 of the sight portion 40 of the rear bow sight 10. Preferably the fibers 54 will be housed in a machined groove which holds them tightly in place. The second ends 60 of the fibers are aligned horizontally near the center of the sight window. A contrasting member 76, that covers substantially the lower half of the sight window surrounds each fiber 54, with the second end 60 of each fiber 54 visible against the contrasting member 76. A notch 78 in the contrasting member 76 allows the archer to view directly between the two fibers 54. The forward sight 16 is aligned in this notch 78, between the two fiber optic sight pins 60, when the bow is aimed. Again, the contrasting member 76 is colored so as to best enhance visibility of the fiber optic sight pins.

Because all parts of the rear sight are transparent, except for the contrasting member, the archer is able to see through the rear bow sight enabling the archer to maintain view of the target and know where on the target he is aiming.

It is to be understood that the present invention is not limited to the embodiments described above, but encompasses any and all embodiments within the scope of the following claims.

I claim:

1. A rear sight for a bow having a bowstring and forward sight, said rear sight comprising:

a. a transparent planar mounting member adapted for attachment to a bowstring;

b. a sight portion comprising a transparent and hollow member, defining an aperture for use as a sight window, centrally located on said mounting member, said hollow member and said aperture being disposed at a 45° angle, whereby, when mounted on a bowstring which is pulled back, said sight window aligns with the archer's eye and the forward sight for aiming an arrow; and c. means for preventing rotation of said rear sight about a longitudinal axis of the bowstring, said means for preventing rotation of said rear sight being attached to said mounting member.

2. The rear sight according to claim 1, wherein said means for preventing rotation of said rear sight comprises an alignment arm for elastically connecting said mounting member to the bow.

3. The rear sight as defined in claim 1, wherein said mounting member further-comprises an edge having a first groove running along its length and an opposite edge having a second groove running along its length for receiving the bowstring wherein said bowstring runs along both of said grooves for securing said mounting member to said bowstring.

4. The rear sight as defined in claim 1, wherein said sight portion is provided with a fiber optic sight pin having a first end, a middle portion, and a second end, wherein said first end is affixed to said mounting member, said middle portion wraps about the exterior of said sight portion and said second end extends to a central location within said sight window, said second end is further provided with a bend, whereby, when attached to the bow, said second end faces away from the bow toward the archer allowing light transmitted through said fiber optic to be used as a sight pin.

5. The rear sight as defined in claim 4, wherein said fiber optic sight pin is provided with a contrasting member attached to and extending circumferentially along the lower 330° of said second end of said fiber optic sight pin for providing a background against which said fiber optic sight pin is highly visible.

6. The rear sight as defined by claim 1, wherein said sight portion further comprises:

a. a pair of fiber optic sight pins, each having a first end, a middle portion, and a second end adapted such that, when attached to said bow, said first end is oriented toward the bow and the second end faces the archer, with the middle extending across said hollow member of said sight portion, wherein said second ends of said sight pins are horizontally aligned and spaced such that the front sight pin may be viewed between the two for aiming the bow;

b. a contrasting member for increasing visibility of said fiber optic sight pins wherein said contrasting member surrounds both of said fiber optic sight pins, defining a notch therebetween for viewing said front sight pin, and covering substantially the lower half of said sight portion.

7. The rear sight as defined in claim 1, wherein said hollow member of said sight portion has a circular cross-sectional shape.

* * * * *